US006789758B2

(12) United States Patent
Duncan

(10) Patent No.: US 6,789,758 B2
(45) Date of Patent: Sep. 14, 2004

(54) STEP-WOUND PACKAGE OF TAPE

(75) Inventor: John Edward Duncan, Dayville, CT (US)

(73) Assignee: Web Industries, Inc., Westborough, MA (US)

( * ) Notice: Subject to any disclaimer, the term of this patent is extended or adjusted under 35 U.S.C. 154(b) by 0 days.

(21) Appl. No.: 10/235,426

(22) Filed: Sep. 5, 2002

(65) Prior Publication Data

US 2003/0047632 A1 Mar. 13, 2003

Related U.S. Application Data

(60) Provisional application No. 60/318,100, filed on Sep. 7, 2001.

(51) Int. Cl.[7] ..... B65H 18/28
(52) U.S. Cl. ..... 242/160.2; 242/471
(58) Field of Search ..... 242/160.2, 170, 242/471

(56) References Cited

U.S. PATENT DOCUMENTS 1,215,934 A * 2/1917 Heckman ..... 242/471
2,372,400 A * 3/1945 Smith ..... 242/477
2,692,738 A * 10/1954 Seaman ..... 242/483.5
3,023,888 A * 3/1962 Scott ..... 242/160.2
3,997,122 A * 12/1976 Helfand et al. ..... 242/160.2
4,093,146 A 6/1978 Haley
4,477,035 A 10/1984 O'Connor
4,477,036 A * 10/1984 Rundo ..... 242/471
4,545,549 A * 10/1985 Rundo ..... 242/388.9
4,568,033 A 2/1986 O'Connor
4,603,817 A 8/1986 O'Connor
RE32,608 E 2/1988 O'Connor
6,007,016 A 12/1999 Helton
6,138,934 A 10/2000 Helton
6,209,814 B1 4/2001 Helton

* cited by examiner

*Primary Examiner*—Kathy Matecki
*Assistant Examiner*—Sang K Kim
(74) *Attorney, Agent, or Firm*—Wolf, Greenfield & Sacks

(57) ABSTRACT

A package of tape including a plurality of body portions. Each body portion is formed as a series of steps, each step including a plurality of turns of tape that are wrapped about a core. During formation of each step, the winding position of the tape is varied. In one embodiment, the winding position of the tape is oscillated a fraction of the width of the tape per revolution of the core, or during a revolution of the core. In an alternative embodiment, the winding position of the tape is varied by a fraction of the width of the tape in a first direction after each approximately full turn of tape. During formation of an immediately adjacent step in the same body portion, the winding position of the tape is varied by a fraction of the width of the tape in a second direction, opposite the first direction.

94 Claims, 3 Drawing Sheets

STEP-WOUND PACKAGE OF TAPE

This application claims priority under 35 U.S.C.§ 119 (e) to U.S. provisional patent application serial No. 60/318,100, entitled "Step-Wound Package of Tape," filed Sep. 7, 2001, by John Duncan, which is incorporated herein by reference in its entirety.

FIELD OF THE INVENTION

The present invention is directed to a wound package of tape, and more particularly, to a step-wound package of tape and method and apparatus for making the same.

BACKGROUND OF THE INVENTION

For many years, tape was wound onto a flat bank or cylindrical core in a single spiral where one layer or turn of tape lies directly on top of the previous layer or turn. Dependent upon the width of the tape and slipperiness of the material from which the tape is formed, the amount of tape that can be wrapped in such a single spiral is limited, as the greater the amount of tape, the less stable the package formed therefrom.

To increase the amount of tape that can be wrapped about a blank or core, a method termed "traverse winding" has been used in which the winding position of the tape is traversed back and forth axially of the blank or core. Although traverse-winding permits a greater amount of tape to be wound about the blank or core than in a single spiral wound package, the end portions of the package of tape are prone to telescoping or collapse. This problem is known as "edge drop-off." In addition, for certain tape materials having a high memory (i.e., those tape materials that tend to retain the shape in which they are wound about the blank or core), traverse winding can impart a lasting shape to the tape material that may interfere with its intended use.

U.S. Pat. Nos. Re 32,608, 4,568,033 and 4,603,817 to O'Connor are directed to a package of tape and method and apparatus for making a package of tape that overcome some of the above-mentioned problems. For example, in Re 32,608 and 4,603,817, a plurality of turns of tape are spirally wound in a fixed position without any traversal before proceeding to a next position spaced axially of the core. The package of tape so formed includes a number of body portions of tape formed from between 2 and 10 spirally wrapped turns of tape that are adjoined to one another by a helical traverse. The edges of the each of the plurality of spirally wrapped turns of tape of each of the body portions lie between the same pair of radial planes spaced axially of the package body. As each of the body portions of the package of tape are built up in a series of steps, such a package of tape is termed a "step-wound" package of tape.

In U.S. Pat. No. 4,568,033, each end position of the package of tape includes a plurality of spirally wrapped turns of tape that are formed in a series of steps. However, the interior region of the package is formed from overlapping traversals back and forth between the end positions to fill in the interior region. When the interior portion of the package attains the height of the end positions, the process is repeated.

SUMMARY OF THE INVENTION

According to one embodiment of the present invention, a package of tape wound about a cylindrical core is provided. The package of tape comprises a plurality of cylindrical body portions spaced apart along a length of the core, each respective body portion of the plurality of body portions including a plurality of turns of tape. Edges of each of the plurality of turns of tape in each respective body portions are aligned within a respective pair of radial planes spaced apart along the length of the core and within each respective body portion, each approximately full turn of tape of the plurality of turns of tape is offset from an immediately adjacent approximately full turn of tape by a fraction of a width of the tape.

According to another embodiment of the present invention, a package of tape wound about a cylindrical core is provided that comprises a plurality of cylindrical body portions space apart along a length of the core. Each respective body portion of the plurality of body portions includes a plurality of turns of tape. Edges of each of the plurality of turns of tape in each respective body portion are aligned within a respective pair of radial planes spaced apart along the length of the core. Within each respective body portion, a portion of each respective turn of tape of the plurality of turns of tape is offset from an immediately adjacent portion of the respective turn of tape by a fraction of a width of the tape.

According to another embodiment of the present invention, a package of tape wound about a cylindrical core is provided. The package of tape comprises a plurality of cylindrical body portions spaced apart along a length of the core, each respective body portion of the plurality of body portions including a first plurality of turns of tape. Edges of each successive turn of tape of the first plurality of turns of tape in each respective body portion are offset by a fraction of a width of the tape from edges of an immediately prior turn of tape in a first direction. Each respective body portion of the plurality of body portions further includes a second plurality of turns of tape overlying the first plurality of turns of tape, edges of each successive turn of tape of the second plurality of turns of tape in each respective body portion being offset from edges of an immediately prior turn of tape in a second direction that is opposite the first direction.

According to another aspect of the present invention, a method of building a package of tape is provided. The method includes acts of wrapping a first plurality of turns of tape about a cylindrical core at a first position defined by a first pair of radial planes spaced apart along a length of the core so that edges of each approximately full turn of tape of the first plurality of turns of tape are laterally offset from edges of an immediately adjacent turn of tape by a fraction of a width of the tape and within the first pair of radial planes; traversing to a second position defined by a second pair of radial planes spaced apart along the length of the core; and wrapping a second plurality of turns of tape about the cylindrical core at the second position so that edges of each approximately full turn of tape of the second plurality of turns of tape are laterally offset from edges an immediately adjacent turn of tape by the fraction of the width of the tape and within the second pair of radial planes.

According to a further embodiment of the present invention a method of building a package of tape is provided. The method includes acts of wrapping a first plurality of turns of tape about a cylindrical core at a first position defined by a first pair of radial planes spaced apart along a length of the core so that edges of a portion of each respective turn of tape of the first plurality of turns of tape are laterally offset from edges of an immediately adjacent portion of the respective turn of tape by a fraction of a width of the tape and within the first pair of radial planes; traversing to a second position defined by a second pair of radial planes spaced apart along the length of the core; and wrapping a second plurality of turns of tape about the cylindrical core at the second position so that edges of a portion of each respective turn of tape of the second plurality of turns of tape are laterally offset from edges of an immediately adjacent portion of the respective turn of tape by the fraction of the width of the tape and within the second pair of radial planes.

According to yet another embodiment of the present invention, a method of building a package of tape is provided comprising acts of wrapping a first plurality of turns of tape about a cylindrical core at a first position defined by a first pair of radial planes spaced apart along a length of the core so that edges of each successive turn of tape of the first plurality of turns of tape are laterally offset in a first direction by a fraction of a width of the tape from edges of an immediately prior turn of tape and within the first pair of radial planes; traversing to a second position defined by a second pair of radial planes spaced apart along the length of the core, the second pair of radial planes being distinct from the first pair of radial planes; and wrapping a second plurality of turns of tape about the cylindrical core at the second position so that edges of each successive turn of tape of the second plurality of turns of tape are laterally offset in the first direction by the fraction of the width of the tape from edges of an immediately prior turn of tape and within the second pair of radial planes. According to this embodiment, the act of traversing may include an act of wrapping an approximately full turn of tape that contacts one of the edges of each of the first plurality of turns of tape during the act of traversing.

According to the various embodiments of the present invention described herein, a package of tape is provided having firm edge windings that are less susceptible to edge damage than a traditional helical traverse wound package, and in which variations in the offset of adjacent layers in a body portion interlock the layers of tape to improve the stability of the package of tape. With respect to the end position body portions, the interlocking of layers of tape in each end position body portion with layers of tape of an immediately adjacent body portion helps to prevent multiple layers of tape from dropping off, should one of the top-most layers be displaced. This is in contrast to a conventional step wound package of tape in which displacement of a top-most layer of tape of an end position body portion will typically bring underlying layers of tape of the same step along with it. Further, because each of the layers of tape in a step of an end position body portion is interlocked with a layer of tape in an immediately adjacent body portion, a greater number of layers of tape may be wound in a step of the end position body portion before securing those layers of tape to the immediately adjacent body portion by a traversal to the immediately adjacent body portion. This, in turn, can reduce the number of times each end position body portion is visited during winding, further enhancing the stability of the end position body portions, and thus, the package of tape.

Additionally, the slight feathering that is created by variations in the offset of layers of tape in adjacent body portions creates a soft shoulder for the tape material as it traverses from one body portion to an adjacent body portion when the tape is wound and unwound. This minimizes deformation of the tape material and reduces stress to the tape material. It should be appreciated that the heightened stability of each of the body portions, and especially the end position body portions, and the soft shoulder between adjacent body portions permits a greater number of layers of tape to be wound in each body portion. This, in turn, allows formation of a larger diameter package of tape that can include a greater amount of tape than with conventional method of winding.

DETAILED DESCRIPTION OF THE INVENTION

As used herein, the term "tape" is defined to mean any narrow strip or band of woven or non-woven material, such as fabric, plastic, metal, or paper that is sufficiently flexible so as to be wound about a flat blank or cylindrical core to form a package.

According to an aspect of the present invention, a package of tape is provided that includes a plurality of body portions each formed as a series of steps, each step including a plurality of turns of tape that are wrapped about a core. After a step is formed in a first body portion (e.g., body portion 30*a* in FIG. 1), the winding position of the tape is traversed in a first direction (e.g., from left to right in FIG. 1) axially of the core to form a step in an adjacent body portion (e.g., body portion 30*b* in FIG. 1). The process of forming a step in a body portion and traversing in the first direction to form a step in an adjacent body portion is repeated until a step is formed in a last body portion (e.g., body portion 30*j* in FIG. 1). After forming the step in the last body portion, the winding position is traversed in a second direction, opposite to the first direction, to form a next step in the adjacent body portion (e.g., body portion 30*i* in FIG. 1). Each body portion is thus formed as a series of steps, each step including a plurality of turns of tape.

According to an aspect of the present invention, during the formation of each step of a body portion, the winding position of the tape is varied. In one embodiment of the present invention, during the formation of each step of a body portion, the winding position of the tape is oscillated a fraction of the width of the tape. The winding position may be oscillated per revolution of the core, or during a revolution of the core, as described further in detail below. In an alternative embodiment, during the formation of each step of a body portion, the winding position of the tape is varied by a fraction of the width of the tape in a first direction after each approximately full turn of tape. During the formation of the immediately adjacent step in the same body portion, the winding position of the tape is varied by a fraction of the width of the tape in a second direction, opposite to the first direction.

As will be described in detail below, embodiments of the present invention provide a dense package of tape in which the body portions are interlocked with one another and in which edge-drop off is minimized.

Figure 1:
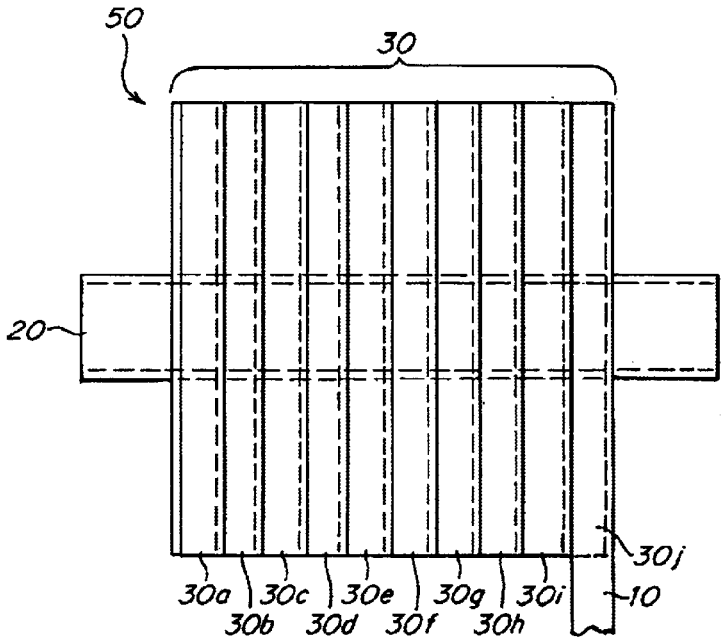
FIG. 1 is a schematic front elevation view of a step wound package of tape according to one embodiment of the present invention.

FIG. 1 is a schematic front elevation view of a step-wound package of tape according to one embodiment of the present invention. As shown in FIG. 1, the package of tape 50 includes a plurality of body portions 30 axially displaced from one another about a cylindrical core 20. Although the core 20 is typically made from cardboard, it should be appreciated that the core 20 may be made from any suitable material, for example, from plastic or fibreboard. Moreover, it should be appreciated that rather than a cylindrical core, a flat blank may alternatively be used, as the present invention is not limited to any particular wrapping surface.

Each of the plurality of body portions 30*a*–30*j* includes a plurality of turns of tape 10 disposed on top of one another. According to one embodiment of the present invention, the winding position of the tape 10 is maintained stationary for approximately one full turn before being displaced a fraction of the width of the tape to wind an immediately overlying turn of tape. After winding the immediately overlying turn of tape, the winding position is then reversed in the opposite direction back to the first position. Depending on the thickness of the tape and the characteristics of the tape material (for example, its width, its slipperiness, its stiffness, etc.), this process may be repeated a number of times, with the number of turns of tape in each step generally including between 2 to 10 turns of tape. Thus in forming a step in each body portion 30*a*–30*j*, the winding position of the tape is oscillated back and forth a fraction of the width of the tape. The slight amount of offset between immediately adjacent turns of tape is shown in FIG. 1, where the solid line represents the outermost turn of tape and the dotted line represents the immediately adjacent inner turn of tape.

After winding a plurality of turns of tape to form a step of the first body portion 30*a*, the winding position is then traversed (i.e., displaced along the core 20) so that a first layer of tape may be wrapped about the core at the second winding position 30*b*. As depicted in FIG. 1, except for the helical portion of the tape that is wound during traversal from the first body portion 30*a* to an adjacent body portion (e.g., 30*b*), the plurality of turns of tape in each body portion 30 do not overlap any of the plurality of turns of an adjacent body portion. During the winding of a step in the second body portion 30*b*, after each approximately full turn of tape, the winding position of the tape is traversed back and forth a fraction of the width of the tape before traversing along the core 20 to form a step of the next body portion 30*c*. The process of winding turns of tape continues to end body portion 30*j*, wherein approximately twice the number of turns of tape are wrapped before traversing back to the initial body portion 30*a* in a similar manner.

Upon returning to the initial body portion 30*a*, approximately twice the number of turns are wrapped in a step before traversing to continue winding the next step of the second body portion 30*b*. It should be appreciated that each step of the end body portions 30*a* and 30*j* will generally include approximately twice the number of successive turns of tape as a step of the intermediate body portions 30*b* through 30*i*, so that approximately the same number of turns are wrapped in each body portion 30 during the formation of the package of tape 50. Although the number of turns of type in each step of an end body portion will typically be approximately twice the number of turns in a step of an intermediate body portion, it should be appreciated that the present invention is not so limited. In this regard, the number of turns in a step in each of the end body portions may be substantially greater than twice the number of turns of an immediately adjacent body portion, and may include from two to ten times the number of turns of tape in the immediately adjacent body portion, as discussed further below. It should further be appreciated that each of the body portions 30 of the package of tape 50 is thus formed as a series of steps, each step including a plurality of turns of tape 10.

The above described process of winding a plurality of turns at each position may be termed a per-revolution oscillating step-winding process, as during the formation of each step in a body portion, the winding position of the tape 10 is oscillated back and forth a fraction of the width of the tape after approximately one full turn of the core 20. However, despite this terminology, it should be appreciated that the slight amount of offset provided during the winding of successive turns of tape in a step of a respective body portion need not be performed after (or before) exactly one full turn, as the present invention is not so limited. Moreover, although this embodiment has been described in terms of integral turns of tape, it should be appreciated that to provide a more uniform package of tape, the number of turns of tape in each step of a body portion is generally not a whole number of turns, but slightly more or slightly less than a whole number of turns. Further, it should be appreciated that in order to provide a uniform package of tape, traversals between adjacent body portions may be staggered (i.e., not performed at the same degree of rotation of the core 20) to avoid a build-up of material at any one location, as known to those skilled in the art.

Figure 2:
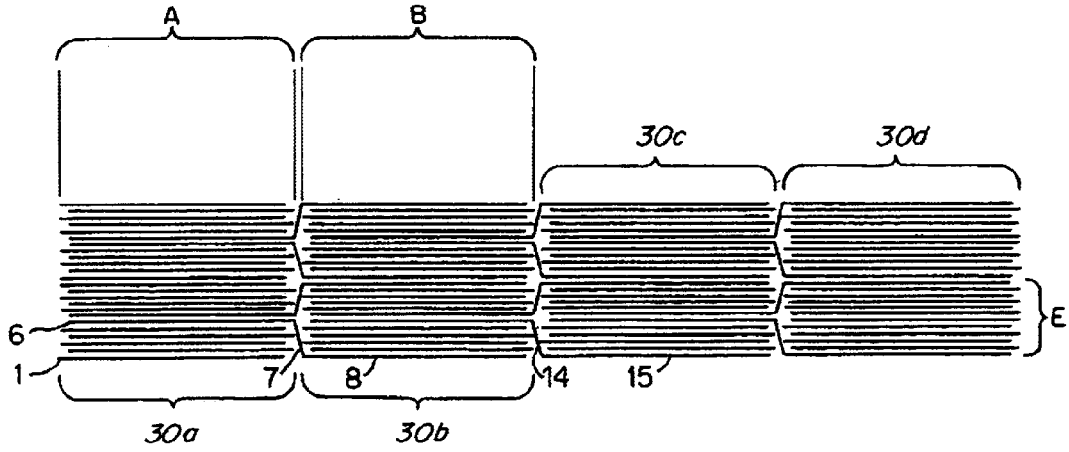
FIG. 2 is a schematic cross-sectional view of the package of FIG. 1 according to another embodiment of the present invention.

FIG. 2 is a schematic cross-sectional view of the package of FIG. 1 according to the above described embodiment of the present invention. As shown in FIG. 2, each of the plurality of body portions (30*a*–30*d*) includes a plurality of turns in which each turn is slightly offset from an immediately adjacent turn. In the example shown in FIG. 2, each step of an intermediate body portion (e.g., 30*b*, 30*c*) includes approximately six full turns of tape, with the steps in each of the end body portions (30*a* and 30*d*) including approximately twice the number of approximately full turns (e.g., step E in body portion 30*d*) of tape 10. In the exemplary diagram of FIG. 2, approximately six full turns of tape are wound in the first step of the first body portion 30*a* before the winding position of the tape is traversed to wind the first step in the second body portion 30*b*, wherein approximately six full turns of tape are wound. Approximately one full turn (e.g., turn 7) is wound during the helical traversal from one body portion (e.g., 30*a*) to the next adjacent body portion (e.g., 30*b*), although the amount of rotation of the core 20 during the traversal may be more or less than one full turn. For example, the traversal from one body portion to an adjacent body portion may take place during as little as one half a revolution of the core, or during multiple revolutions of the core.

In general, the number of turns in each step may be varied depending upon the thickness and the width of the tape, the slipperiness or stiffness of the material from which the tape is made, as well as other factors. As may also be seen in FIG. 2, during the formation of each step of a body portion, the winding position of the tape oscillates between positions slightly offset from one another by a fraction of the width of the tape before or after each approximately full turn of tape (i.e., before or after each approximately full revolution of the core 20). Thus, as shown in FIG. 2, each of the plurality of turns of tape in body portion 30*a* lies between two radial planes A axially spaced apart on the core. Adjacent body portions (e.g., body portion 30*b*) also lay between a pair of radial planes (planes B) spaced axially apart on the core. Each pair of planes (A and B) of this embodiment is spaced a fraction of the width of the tape apart from those defining an adjacent position.

The distance by which adjacent turns of tape in a step are offset from one another is approximately 1/64 to 1/4 of the width of the tape. It should be appreciated, however, that the amount of offset may be varied according to the width of the tape as well as the coefficient of friction of the tape, or the stiffness of the tape. For example, as the tape material that is used becomes more slippery, Applicants have found that the amount of offset may be increased to better interlock the package. Furthermore, as the width of the tape is reduced, a greater amount of offset may be preferred to promote interlocking.

As shown in FIG. 2, the offsetting of adjacent turns of tape creates a feathered edge which lessens the chance of the tape binding between adjacent body portions when wound or unwound. Furthermore, the slight offset of the immediately adjacent turns of tape acts to deter edge drop-off. For example, referring to the first body portion 30*a* in FIG. 2, while it is possible for the top layer to drop-off, the second turn of tape effectively locks the lower portions of tape into position to avoid drop-off. Applicants have found that a minimal amount of offset is generally preferred so as to maximize the amount of tape that can be wound onto a given length of the package. Edge drop-off in intermediate body portions 30*b*, 30*c* is effectively prevented by adjacent body portions (e.g., body portions 30*a* and 30*c*, and 30*b* and 30*d*, respectively).

Figure 3:
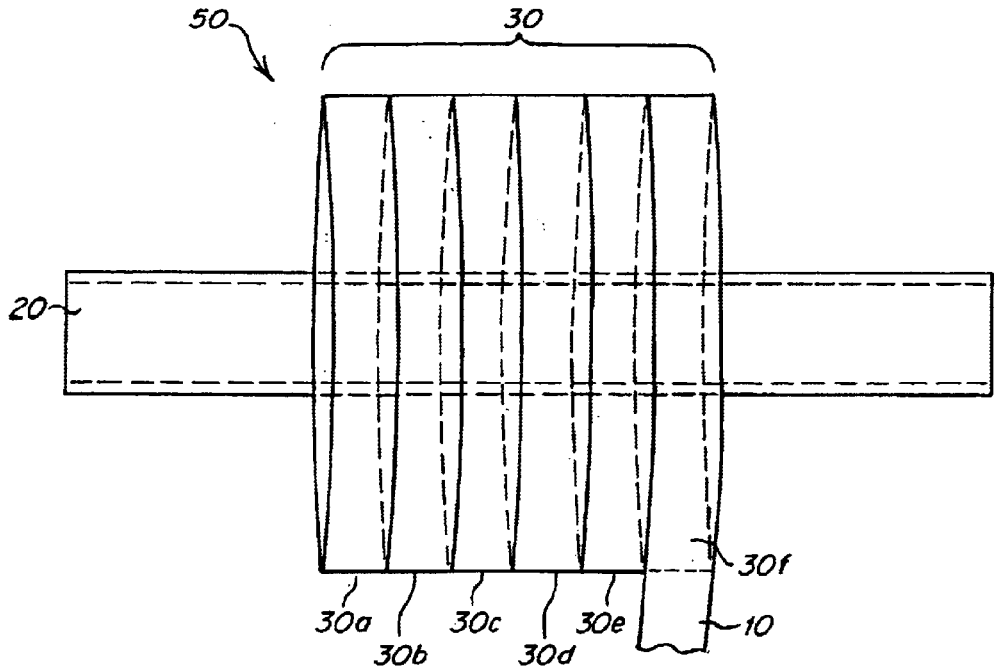
FIG. 3 is a schematic front elevation view of a step wound package of tape according to another embodiment of the present invention.

FIG. 3 is a schematic front elevation view of a step-wound package of tape according to another embodiment of the present invention. As in the embodiment described with respect to FIGS. 1 and 2, the package of tape 50 includes a plurality of body portions 30 axially displaced from one another about a cylindrical core 20. Each of the plurality of body portions 30*a*–30*f* includes a plurality of turns of tape 10 disposed on top of one another. However, in contrast to the embodiment described with respect to FIG. 1, rather than varying the winding position of the tape before or after approximately every full turn, the winding position of the tape is varied during the approximately full turn. Such an embodiment may be termed a during-revolution step-winding process. The amount of variation in the winding position when forming a step in each body portion 30 is again a fraction of the width of the tape 10, and the variation in the winding position during each approximately full turn may be discrete or continuous. Thus, in contrast to the embodiment of FIG. 2 in which the edges of every other approximately full layer of tape are aligned, the edges immediately adjacent layers of tape in the embodiment of FIG. 3 are not aligned. The slight amount of variation in the winding position of the tape 10 during each turn of tape is shown in FIG. 3, where solid lines represent edges of the outermost turns of tape and dotted lines represent the edges of an immediately adjacent inner turn of tape. The amount of variation in the winding position during each turn of tape of in a step of a body portion 30 is typically a fraction of the width of the tape, for example 1/64 to 1/4 the width of the tape. However, as discussed above, the amount of variation may be varied dependent upon the width of the tape and the slipperiness of the material from which the tape is formed.

During formation of the package 50, after winding a plurality of turns of tape of the first body portion 30*a* in which the winding position is varied a fraction of the width of the tape during each turn, the winding position is then traversed (i.e., displaced along the core) so that a first layer of tape may be wrapped about the core at the second winding position 30*b*. During the winding of the second body portion 30*b*, the winding position of the tape is again varied a fraction of the width of the tape during each turn before traversing to form the next body portion 30*c*. The process of winding turns of tape continues to end body portion 30*j*, wherein approximately twice the number of turns of tape are wrapped before traversing back to the initial body portion 30*a* in a similar manner.

Upon returning to the initial body portion 30*a*, approximately twice the number of turns are wrapped before traversing to continue winding the second body portion 30*b*. As in the embodiment described with respect to FIG. 1, each of the end body portions 30*a* and 30*j* will generally include approximately twice the number of turns successive turns of tape as the intermediate body portions 30*b* through 30*i*, so that approximately the same number of turns are wrapped in each body portion 30 during the formation of the package of tape 50. Depending on the characteristics of the tape material and the intended usage for the tape, it should be appreciated that steps in each of the end body portions may include more than twice the number of turns of tape than the steps of an immediately adjacent body portion It should also be appreciated, that like the embodiment described with respect to FIG. 1, each of the body portions 30 of the package of tape are thus formed as a series of steps, each step including a plurality of turns of tape 10.

Figure 4:
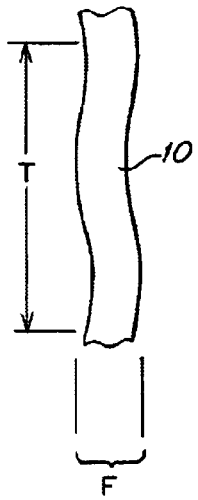
FIG. 4 illustrates one manner in which the winding position of tape may be varied in the embodiment of FIG. 3.
Figure 5:
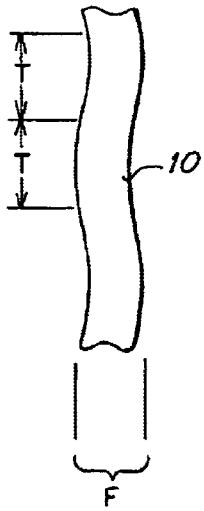
FIG. 5 illustrates a different manner in which the winding position of tape may be varied in the embodiment of FIG. 3.

FIGS. 4 and 5 illustrate the manner in which the winding position of tape may be varied according to this embodiment of the present invention. In each of FIGS. 4 and 5 the winding position of the tape is varied or oscillated in a continuous manner during a turn or revolution of the core so that the edges of the tape in each body portion fall within a pair of radial planes F spaced axially of the core. Specifically, in FIGS. 4 and 5, the winding position of the tape 10 is continuously varied a fraction of the width of the tape in each direction during each full turn. For example, as shown in FIG. 4, during one full turn T, the winding position of the tape is varied fully in each direction (left and right in FIG. 4) a fraction of the width of the tape. To ensure that the edges of a layer of tape are displaced from the edges of the immediately adjacent layer, one full turn of tape T is more than one full oscillation (left and right), as shown in FIG. 4. Alternatively, to ensure that the edges of a layer of tape are displaced from the edges of the immediately adjacent layer, one full turn of tape T may be less than one full oscillation, as shown in FIG. 5. In each of these embodiments, the amount of oscillation during a full turn is controlled such that the edges of adjacent layers of tape are laid in an essentially random manner, as depicted in FIG. 6.

Figure 6:
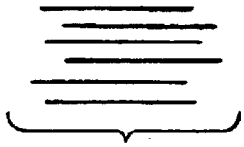
FIG. 6 is an exemplary schematic cross-section view of a body portion of a package of tape according to the embodiment of FIG. 3.

Although FIGS. 4–6 have been described in terms of a continuous variation in the winding position of the tape during the formation of each body portion, it should be appreciated that the present invention is not so limited. For example, rather than the winding position being continuously varied when forming each turn of a step of a body portion, the winding position may be varied discretely during each turn of tape or revolution of the core to achieve a similar result. Moreover, it is not required that the edges of adjacent layer of tape be laid in an entirely random manner, as some amount of alignment in the edges of adjacent layers of tape may take place. As in previously described embodiments, the slight offsetting of the edges of tape in each step deter edge drop-off and creates a feathered edge that aids in unwinding.

Figure 7:
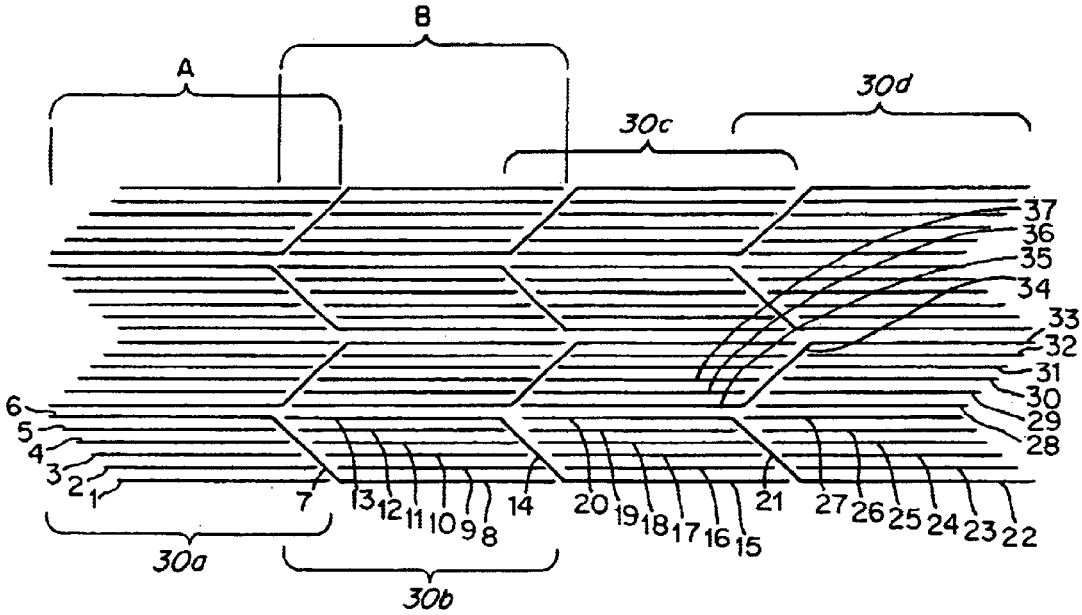
FIG. 7 is a schematic cross-sectional view of the package of FIG. 1 according to another embodiment of the present invention.

FIG. 7 is a schematic cross-sectional view of the package of FIG. 1 according to another embodiment of the present invention. In contrast to the embodiment of FIG. 2 in which the edges of every other layer of tape are aligned within a pair of non-overlapping radial planes (planes A and B in FIG. 2) spaced apart axially on the core, the edges of tape in the embodiment of FIG. 7 are not. Specifically, in the embodiment of FIG. 7, each of the plurality of turns of a step of a body portion are offset from the preceding turn in a particular direction before the next body portion is visited. Thus, to form the package of tape illustrated in FIG. 7, the winding position of the tape is maintained stationary for approximately one full turn before being axially displaced a fraction of the width of the tape in a first direction to wind the next approximately full turn. After winding the next approximately full turn in a stationary position, the winding position in then advanced in the same direction by a fraction of the width of the tape to wind another approximately full turn. This process is repeated to wind a plurality of turns in a step of the body portion before the winding position is traversed to form a step of an adjacent body portion.

As illustrated in FIG. 7, after winding the initial step in each of the body portions 30*a*–30*d*, the advancement of the winding position before or after each approximately full turn is performed in an opposite direction to wind the succeeding step. As may be appreciated by the illustration of FIG. 7, this zigzag approach to winding not only interlocks the lower layers of a given body portion with the upper layers, but it also interlocks adjacent body portions to one another in a very dense package. Although each of the plurality of turns of tape in immediately adjacent body portions 30*a*, 30*b* lies between two radial planes A, B, respectively spaced apart axially on the core, the respective radial planes A and B overlap one another to some degree. This is in contrast to the embodiment depicted in FIG. 2, in which the planes A and B are spaced apart from one another and do not overlap. As in the previously discussed embodiments, the number of turns of tape in a step at the end winding positions (i.e., body portions 30*a* and 30*d*) is approximately twice the number of turns of tape in the intermediate winding positions (i.e., body portions 30*b* and 30*c*), except for the initial step of the first end winding position (i.e., body portion 30*a*).

Although the embodiment described with respect to FIG. 7 has been described in terms of a per-revolution winding process in which the winding position of the tape is varied either before, or after, each approximately full turn of tape in a particular step, it should be appreciated that the variation in the winding position may alternatively be performed during a revolution or turn. For example, when building a first step in a first body portion, the winding position of the tape may be continuously or discretely varied a fraction of the width of the tape in a first direction during each revolution of the core, and then when building the second step in the first body portion, may be continuously or discretely varied a fraction of the width of the tape in a second and opposite direction during each revolution of the core.

In each of the above-described embodiments, it should be appreciated that after winding each of the plurality of body portions (e.g., body portions 30*a*–30*d* in FIG. 2), one or more continuous traverses of tape may be used to lock the outermost turn of tape of each of the plurality of body portions in position. It should also be appreciated that in each of the described embodiments, the amount of variation in the winding position of the tape (either per-revolution or during a revolution) in a first step of a first body portion may be different than the amount of variation in the winding position of the tape in the first step of a second and adjacent body portion. Similarly, the amount of variation in the winding position of the tape (either per-revolution or during a revolution) in different or even adjacent steps of a particular body portion may differ from one another and need not be the same.

Figure 8:
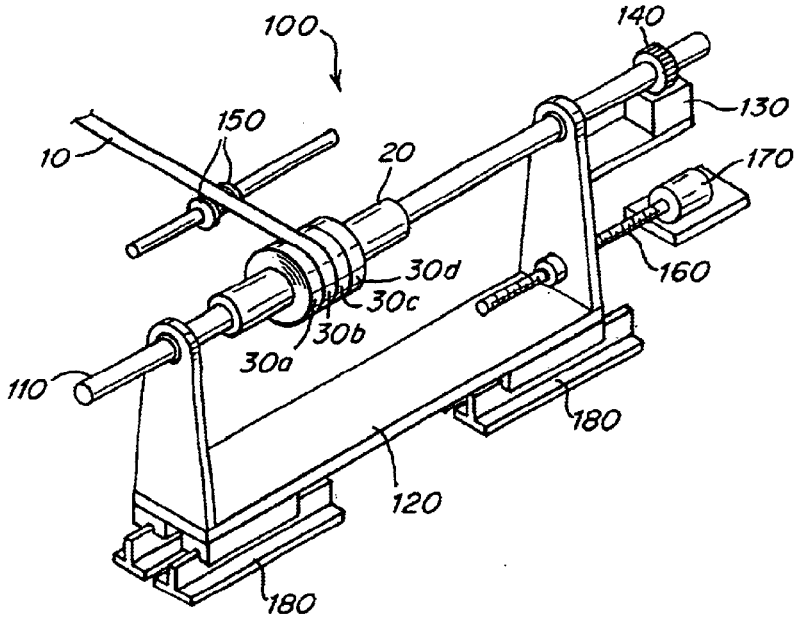
FIG. 8 is a schematic diagram of a winding machine that can be used to make a package of tape according to embodiments of the present invention.

FIG. 8 illustrates a winding machine that may be used to form a package of tape according to the various embodiments of the present invention. As shown, the winding machine 100 includes a shaft 110 rotatably mounted within a traversing support frame 120. The traversing support frame 120 is mounted on glides or linear bearings 180 so that it may be moved transversely to the direction in which tape 10 is provided from a tape supply (not shown). Attached to the traversing support frame 120 is a screw 160 that is driven by a stepping motor 170. Other types of motors may alternatively be used, such as servo motors, or linear motors. A controller (not shown) controls the operation of the stepping or other type of motor 170 to move the traversing support frame back and forth along a direction parallel to the longitudinal axis of the shaft 110. A cylindrical core 20 is fixably mounted to the shaft 110 by any suitable means, such as collars (not shown). A motor 130 drives a gear 140 that is fixed to the shaft 110 to rotate the shaft 110. The tape 10 is attached to the core 20 at a first winding position 30*a*. As tape 10 is fed from the tape supply it is guided by rollers 150 onto the core 20. During operation, as the motor 130 rotates the shaft 110, tape is wound about the core 20. The controller causes the stepping motor 170 to wind a plurality of turns of tape at a first winding position as described above before traversing to an adjacent winding position.

It should be appreciated that although the winding machine 100 described herein utilizes a movable support frame 120 to wind the tape at a plurality of different positions spaced apart axially of the core 20, other types of winding machines may be used. For example, rather than the tape supply and or the roller being fixed in a particular position, the tape supply and/or the rollers 150 may be movable transversely relative to a fixed support frame to achieve a similar result. Other suitable types of winding apparatus may be used, as the present invention is not limited to any particular type of winding apparatus. For example, although each of the above embodiments have been described as including a plurality of turns of tape that are wrapped about a core or blank, advantages of the present invention may also be realized with core-less technology. In one type of core-less winding technology, air is blown through an expandable mandrel during the winding process, with the tape being wrapped about the expandable mandrel. After winding is complete, the air supply to the mandrel is cut off, and the core-less package of tape is then removed from the mandrel. Other types of core-less winding technology may also be used, as the present invention is not limited to a particular type of core-less winding technology. Thus, it should be appreciated that while embodiments of the present invention have been primarily described with respect to core-based winding methods and technology, the present invention is not so limited.

Although embodiments of the present invention have been described as including end body portions in which each step generally includes approximately twice the number of turns as a step in an immediately adjacent body portion, the present invention is not so limited. In this regard, the number of turns in a step of an end body portion may include much more than twice the number of turns of a step in an immediately adjacent body portion. By including more than twice the number of turns of tape in a step of an end body portion relative to an immediately adjacent body portion, it is possible to reduce the number of times each end body portion is visited during the winding of the package of tape.

This, enhances the stability of the end body portions, and thus, the stability of the package of tape.

Having described several embodiments of the present invention in detail, various modifications and improvements will readily occur to those skilled in the art. Such modifications and improvements are intended to be within the scope of the present invention. Accordingly, the foregoing description is by way of example only, and is not intended as limiting. The invention is limited only as defined by the following claims and equivalents thereto.

What is claimed is:

1. A package of tape wound about a cylindrical core, comprising:

a plurality of cylindrical body portions spaced apart along a length of the core, each respective body portion of the plurality of body portions including a plurality of turns of tape;

wherein edges of each of the plurality of turns of tape in each respective body portion are aligned within a respective pair of radial planes spaced apart along the length of the core;

wherein within each respective body portion, each approximately full turn of tape of the plurality of turns of tape is offset from an immediately adjacent approximately full turn of tape by a fraction of a width of the tape;

wherein the fraction of the width of the tape is a first fraction, and wherein each respective body portion is spaced apart from an immediately adjacent body portion by a second fraction of the width of the tape.

2. The package of tape of claim 1, wherein each respective body portion is connected to the immediately adjacent body portion by a respective helical traverse of tape.

3. A The package of tape of claim 2, wherein each respective helical traverse of tape includes approximately one full turn of tape.

4. The package of tape of claim 2, wherein each respective helical traverse of tape includes approximately one half turn of tape.

5. The package of tape of claim 2, wherein each respective helical traverse of tape includes approximately two full turns of tape.

6. The package of tape of claim 1, wherein the plurality of turns of tape in each respective body portion is a first plurality of turns of tape, the first plurality of turns of tape in each respective body portion forming a respective first step, wherein each respective first step is connected to the first step in an immediately adjacent body portion by a respective helical traverse of tape.

7. The package of tape of claim 6, wherein each respective helical traverse of tape includes approximately one full turn of tape.

8. The package of tape of claim 6, wherein each respective body portion of the plurality of body portions further includes a second plurality of turns of tape, the second plurality of turns of tape in each respective body portion forming a respective second step, wherein the second step of each respective body portion overlies the first step of the respective body portion and is separated therefrom by the respective helical traverse of tape.

9. The package of tape of claim 8, wherein the first and second steps in each respective body portion are aligned within the respective pair of radial planes.

10. The package of tape of claim 8, wherein each approximately full turn of tape in each respective second step is offset from an immediately adjacent approximately full turn of tape in the respective second step by the fraction of the width of the tape.

11. The package of tape of claim 10, wherein the respective helical traverse of tape is a first respective helical traverse of tape, and wherein each respective second step is connected to the second step in the immediately adjacent body portion by a second respective helical traverse of tape.

12. The package of tape of claim 1, wherein each respective body portion is connected to an immediately adjacent body portion by a plurality of helical traverses of tape.

13. The package of tape of claim 1, wherein within each respective body portion, each approximately full turn of tape of the plurality of turns of tape is offset from the immediately adjacent approximately full turn of tape by less than one half the width of the tape.

14. The package of tape of claim 1, wherein within each respective body portion, each approximately full turn of tape of the plurality of turns of tape is offset from the immediately adjacent approximately full turn of tape by less than one quarter of the width of the tape.

15. The package of tape of claim 1, wherein within each respective body portion, each approximately full turn of tape of the plurality of turns of tape is offset from the immediately adjacent approximately full turn of tape by less than one thirty-second of the width of the tape.

16. A package of lane wound about a cylindrical core, comprising:

a plurality of cylindrical body portions spaced avail along a length of the core, each respective body portion of the plurality of body portions including a plurality of turns of tape;

wherein edges of each of the plurality of turns of tape in each respective body portion are aligned within a respective pair of radial planes spaced apart along the length of the core;

and wherein within each respective body portion, each approximately full turn of tape of the plurality of turns of tape is offset from an immediately adjacent approximately full turn of tape by a fraction of a width of the tape;

wherein the plurality of turns of tape in each respective body portion is a first plurality of turns of tape, the first plurality of turns of tape in each respective body portion forming a respective first step, wherein each respective first step is connected to the first step in an immediately adjacent body portion by a respective helical traverse of tape;

wherein each respective body portion of the plurality of body portions further includes a second plurality of turns of tape, the second plurality of turns of lane in each respective body portion forming a respective second step, wherein the second step of each respective body portion overlies the first step of the respective body portion and is separated therefrom by the respective helical traverse of tape;

wherein each approximately full turn of lane in each respective second step is offset from an immediately adjacent approximately full turn of lane in the respective second step by the fraction of the width of the tape;

wherein the respective helical traverse of lane is a first respective helical traverse of tape, and wherein each respective second step is connected to the second step in the immediately adjacent body portion by a second respective helical traverse of tape;

wherein the plurality of body portions include first and second end body portions, and at least one intermediate body portion disposed between the first and second end body portions, and wherein the second plurality of turns of tape in the second step of the first end body portion includes approximately twice as many turns as the second plurality of turns of tape in the second step of the at least one intermediate body portion.

17. A package of tape wound about a cylindrical core, comprising:

a plurality of cylindrical body portions spaced apart along a length of the core, each respective body portion of the plurality of body portions including a plurality of turns of tape;

wherein edges of each of the plurality of turns of tape in each respective body portion are aligned within a respective pair of radial planes spaced apart along the length of the core;

and wherein within each respective body portion, each approximately full turn of tape of the plurality of turns of tape is offset from an immediately adjacent approximately full turn of tape by a fraction of a width of the tape;

wherein the plurality of turns of tape in each respective body portion is a first plurality of turns of tape, the first plurality of turns of tape in each respective body portion forming a respective first step, wherein each respective first step is connected to the first step in an immediately adjacent body portion by a respective helical traverse of tape;

wherein each respective body portion of the plurality of body portions further includes a second plurality of turns of tape, the second plurality of turns of tape in each respective body portion forming a respective second step, wherein the second step of each respective body portion overlies the first step of the respective body portion and is separated therefrom by the respective helical traverse of tape;

wherein the plurality of body portions include first and second end body portions, and at least one intermediate body portion disposed between the first and second end body portions, and wherein the second plurality of turns of tape in the second step of the first end body portion includes approximately twice as many turns as the second plurality of turns of tape in the second step of the at least one intermediate body portion.

18. A package of tape wound about a cylindrical core, comprising:

a plurality of cylindrical body portions spaced apart along a length of the core, each respective body portion of the plurality of body portions including a plurality of turns of tape;

wherein edges of each of the plurality of turns of tape in each respective body portion are aligned within a respective pair of radial planes spaced apart along the length of the core;

and wherein within each respective body portion, each approximately full turn of tare of the plurality of turns of tape is offset from an immediately adjacent approximately full turn of tape by a fraction of a width of the tape;

wherein the plurality of turns of tape in each respective body portion is a first plurality of turns of tape, the first plurality of turns of tape in each respective body portion forming a respective first step, wherein each respective first step is connected to the first step in an immediately adjacent body portion by a respective helical traverse of tape;

wherein each respective body portion of the plurality of body portions further includes a second plurality of turns of tape, the second plurality of turns of tape in each respective body portion forming a respective second step, wherein the second step of each respective body portion overlies the first step of the respective body portion and is separated therefrom by the respective helical traverse of tape;

wherein the plurality of body portions include first and second end body portions, and at least one intermediate body portion disposed between the first and second end body portions, and wherein the second plurality of turns of tape in the second step of the first end body portion includes approximately three times as many turns as the second plurality of turns of tape in the second step of the at least one intermediate body portion.

19. A package of tape wound about a cylindrical core, comprising:

a plurality of cylindrical body portions spaced apart along a length of the core, each respective body portion of the plurality of body portions including a plurality of turns of tape;

wherein edges of each of the plurality of turns of tape in each respective body portion are aligned within a respective pair of radial planes spaced apart along the length of the core;

and wherein within each respective body portion, each approximately full turn of tape of the plurality of turns of tape is offset from an immediately adjacent approximately full turn of tape by a fraction of a width of the tape;

wherein the plurality of turns of tape in each respective body portion is a first plurality of turns of tape, the first plurality of turns of tape in each respective body portion forming a respective first step, wherein each respective first step is connected to the first step in an immediately adjacent body portion by a respective helical traverse of tape;

wherein each respective body portion of the plurality of body portions further includes a second plurality of turns of tape, the second plurality of turns of tape in each respective body portion forming a respective second step, wherein the second step of each respective body portion overlies the first step of the respective body portion and is separated therefrom by the respective helical traverse of tape;

wherein the plurality of body portions include first and second end body portions, and at least one intermediate body portion disposed between the first and second end body portions, and wherein the second plurality of turns of tape in the second step of the first end body portion includes more than four times as many turns as the second plurality of turns of tape in the second step of the at least one intermediate body portion.

20. A package of tape wound about a cylindrical core, comprising: a plurality of cylindrical body portions spaced apart along a length of the core each respective body portion of the plurality of body portions including a plurality of turns of tape;

wherein edges of each of the plurality of turns of tape in each respective body portion are aligned within a respective pair of radial planes spaced apart along the length of the core;

wherein within each respective body portion, a portion of each respective turn of tape of the plurality of turns of tape is offset from an immediately adjacent portion of the respective turn of tape by a fraction of a width of the tape;

wherein the fraction of the width of the tape is a first fraction, and wherein each respective body portion is spaced apart from an immediately adjacent body portion by a second fraction of the width of the tape.

21. The package of tape of claim 20, wherein each respective body portion is connected to the immediately adjacent body portion by a respective helical traverse of tape.

22. The package of tape of claim 21, wherein each respective helical traverse of tape includes approximately one full turn of tape.

23. The package of tape of claim 21, wherein each respective helical traverse of tape includes approximately one half turn of tape.

24. The package of tape of claim 21, wherein each respective helical traverse of tape includes approximately two full turns of tape.

25. The package of tape of claim 22, wherein the plurality of turns of tape in each respective body portion is a first plurality of turns of tape, the first plurality of turns of tape in each respective body portion forming a respective first step, wherein each respective first step is connected to the first step iii an immediately adjacent body portion by a respective helical traverse of tape.

26. The package of tape of claim 25, wherein each respective helical traverse of tape includes approximately one full turn of tape.

27. The package of tape of claim 25, wherein each respective body portion of the plurality of body portions further includes a second plurality of turns of tape, the second plurality of turns of tape in each respective body portion forming a respective second step, wherein the second step of each respective body portion overlies the first step of the respective body portion and is separated therefrom by the respective helical traverse of tape.

28. The package of tape of claim 27, wherein the first and second steps in each respective body portion are aligned within the respective pair of radial planes.

29. The package of tape of claim 27, wherein a portion of each respective turn of tape in each respective second step is offset from an immediately adjacent portion of the respective turn of tape by the fraction of the width of the tape.

30. The package of tape of claim 29, wherein the respective helical traverse of tape is a first respective helical traverse of tape, and wherein each respective second step is connected to the second step in the immediately adjacent body portion by a second respective helical traverse of tape.

31. The package of tape of claim 20, wherein each respective body portion is connected to an immediately adjacent body portion by a plurality of helical traverses of tape.

32. The package of tape of claim 20, wherein within each respective body portion, a plurality of portions of each respective turn of tape of the plurality of turns of tape are discretely offset from immediately adjacent portions of the respective turn of tape by a fraction of a width of the tape.

33. The package of tape of claim 32, wherein within each respective body portion, an amount by which any portion of each respective turn of tape of the plurality of turns of tape is offset from any other portion of the respective turn of tape is less than one quarter of the width of the tape.

34. The package of tape of claim 20, wherein within each respective body portion, a plurality of portions of each respective turn of tape of the plurality of turns of tape are continuously offset from immediately adjacent portions of the respective turn of tape by a fraction of a width of the tape.

35. The package of tape of claim 34, wherein within each respective body portion, an amount by which any portion of each respective turn of tape of the plurality of turns of tape is offset from any other portion of the respective turn of tape is less than one quarter of the width of the tape.

36. The package of tape of claim 20, wherein within each respective body portion, a position of the tape oscillates back and forth within the respective pair of radial planes.

37. The package of tape of claim 20, wherein within each respective body portion, a position of the tape oscillates back and forth within the respective pair of radial planes in a substantially aperiodic manner, so that the edges of one approximately full turn of tape of each respective body portion do not regularly and directly overlie the edges of another approximately full turn of tape in the respective body region.

38. A package of tape wound about a cylindrical core, comprising:

a plurality of cylindrical body portions spaced apart along a length of the core, each respective body portion of the plurality of body portions including a plurality of turns of tape;

wherein edges of each of the plurality of turns of tape in each respective body portion are aligned within a respective pair of radial planes spaced apart along the length of the core;

and wherein within each respective body portion, a portion of each respective turn of tape of the plurality of turns of tape is offset from an immediately adjacent portion of the respective turn of tape by a fraction of a width of the tape;

wherein the plurality of turns of tape in each respective body portion is a first plurality of turns of tape, the first plurality of turns of tape in each respective body portion forming a respective first step, wherein each respective first step is connected to the first step in an immediately adjacent body portion by a respective helical traverse of tape;

wherein each respective body portion of the plurality of body portions further includes a second plurality of turns of tape, the second plurality of turns of tape in each respective body portion forming a respective second step, wherein the second step of each respective body portion overlies the first step of the respective body portion and is separated therefrom by the respective helical traverse of tape;

wherein a portion of each respective turn of tape in each respective second step is offset from an immediately adjacent portion of the respective turn of tape by the fraction of the width of the tape;

wherein the respective helical traverse of tape is a first respective helical traverse of tape, and wherein each respective second step is connected to the second step in the immediately adjacent body portion by a second respective helical traverse of tape;

wherein the plurality of body portions include first and second end body portions, and at least one intermediate body portion disposed between the first and second end body portions, and wherein the second plurality of turns of tape in the second step of the first end body portion includes approximately twice as many turns as the second plurality of turns of tape in the second step of the at least one intermediate body portion.

39. A package of tape wound about a cylindrical core, comprising:

a plurality of cylindrical body portions spaced apart along a length of the core, each respective body portion of the plurality of body portions including a plurality of turns of tape;

wherein edges of each of the plurality of turns of tape in each respective body portion are aligned within a respective pair of radial planes spaced apart along the length of the core;

and wherein within each respective body portion, a portion of each respective turn of tape of the plurality of turns of tape is offset from an immediately adjacent portion of the respective turn of tape by a fraction of a width of the tape;

wherein the plurality of turns of tape in each respective body portion is a first plurality of turns of tape, the first plurality of turns of tape in each respective body portion forming a respective first step, wherein each respective first step is connected to the first step in an immediately adjacent body portion by a respective helical traverse of tape;

wherein each respective body portion of the plurality of body portions farther includes a second plurality of turns of tape, the second plurality of turns of tape in each respective body portion forming a respective second step, wherein the second step of each respective body portion overlies the first step of the respective body portion and is separated therefrom by the respective helical traverse of tape;

wherein the plurality of body portions include first and second end body portions, and at least one intermediate body portion disposed between the first and second end body portions, and wherein the second plurality of turns of tape in the second step of the first end body portion includes approximately twice as many turns as the second plurality of turns of tape in the second step of the at least one intermediate body portion.

40. A package of tape wound about a cylindrical core, comprising:

a plurality of cylindrical body portions spaced apart along a length of the core, each respective body portion of the plurality of body portions including a plurality of turns of tape;

wherein edges of each of the plurality of turns of tape in each respective body portion are aligned within a respective pair of radial planes spaced apart along the length of the core;

and wherein within each respective body portion, a portion of each respective turn of tape of the plurality of turns of tape is offset from an immediately adjacent portion of the respective turn of tape by a fraction of a width of the tape;

wherein the plurality of turns of tape in each respective body portion is a first plurality of turns of tape, the first plurality of turns of tape in each respective body portion forming a respective first step, wherein each respective first step is connected to the first step in an immediately adjacent body portion by a respective helical traverse of tape;

wherein each respective body portion of the plurality of body portions further includes a second plurality of turns of tape, the second plurality of turns of tape in each respective body portion forming a respective second step, wherein the second step of each respective body portion overlies the first step of the respective body portion and is separated therefrom by the respective helical traverse of tape;

wherein the plurality of body portions include first and second end body portions, and at least one intermediate body portion disposed between the first and second end body portions, and wherein the second plurality of turns of tape in the second step of the first end body portion includes approximately three times as many turns as the second plurality of turns of tape in the second step of the at least one intermediate body portion.

41. A package of tape wound about a cylindrical core, comprising:

a plurality of cylindrical body portions spaced apart along a length of the core, each respective body portion of the plurality of body portions including a plurality of turns of tape;

wherein edges of each of the plurality of turns of tape in each respective body portion are aligned within a respective pair of radial planes spaced apart along the length of the core;

and wherein within each respective body portion, a portion of each respective turn of tape of the plurality of turns of tape is offset from an immediately adjacent portion of the respective turn of tape by a fraction of a width of the tape;

wherein the plurality of turns of tape in each respective body portion is a first plurality of turns of tape, the first plurality of turns of have in each respective body portion forming a respective first step, wherein each respective first step is connected to the first step in an immediately adjacent body portion by a respective helical traverse of tape;

wherein each respective body portion of the plurality of body portions further includes a second plurality of turns of tape, the second plurality of turns of tape in each respective body portion forming a respective second step, wherein the second step of each respective body portion overlies the first step of the respective body portion and is separated therefrom by the respective helical traverse of tape;

wherein the plurality of body portions include first and second end body portions, and at least one intermediate body portion disposed between the first and second end body portions, and wherein the second plurality of turns of tape in the second step of the first end body portion includes more than four times as many turns as the second plurality of turns of tape in the second step of the at least one intermediate body portion.

42. A package of tape wound about a cylindrical core, comprising:

a plurality of cylindrical body portions spaced apart along a length of the core, each respective body portion of the plurality of body portions including a first plurality of turns of tape, edges of each successive turn of tape of the first plurality of turns of tape in each respective body portion being offset by a fraction of a width of the tape from edges of an immediately prior turn of tape in a first direction;

wherein each respective body portion of the plurality of body portions further includes a second plurality of turns of tape overlying the first plurality of turns of tape, edges of each successive turn of tape of the second plurality of turns of tape in each respective body portion being offset from edges of an immediately prior turn of tape in a second direction that is opposite the first direction;

wherein the plurality of body portions include first and second end body portions, and at least one intermediate body portion disposed between the first and second end body portions, and wherein the second plurality of turns of tape of the first end body portion includes approximately twice as many turns as the second plurality of turns of tape in the at least one intermediate body portion.

43. The package of tape of claim 42, wherein the first plurality of turns of tape of each respective body portion form a first step, the second plurality of turns of tape of each respective body portion form a second step, and wherein the first step of each respective body portion is connected to the first step of an immediately adjacent body portion by a respective helical traverse of tape.

44. The package of tape of claim 43, wherein each respective helical traverse of tape includes approximately one half turn of tape.

45. The package of tape of claim 43, wherein each respective helical traverse of tape includes approximately two full turns of tape.

46. The package of tape of claim 43, wherein the respective helical traverse of tape includes approximately one full turn of tape.

47. The package of tape of claim 46, wherein the respective helical traverse of tape contacts one of the edges of each of the first plurality of turns of tape.

48. A package of tape wound about a cylindrical core, comprising:

a plurality of cylindrical body portions spaced apart along a length of the core each respective body portion of the plurality of body portions including a first plurality of turns of tape, edges of each successive turn of tape of the first plurality of turns of tape in each respective body portion being offset by a fraction of a width of the tape from edges of an immediately prior turn of tape in a first direction;

wherein each respective body portion of the plurality of body portions further includes a second plurality of turns of tape overlying the first plurality of turns of tape, edges of each successive turn of tape of the second plurality of turns of tape in each respective body portion being offset from edges of an immediately prior turn of tape in a second direction that is opposite the first direction;

wherein the plurality of body portions include first and second end body portions, and at least one intermediate body portion disposed between the first and second end body portions, and wherein the second plurality of turns of tape of the first end body portion includes approximately three times as many turns as the second plurality of turns of tape in the least one intermediate body portion.

49. A package of tape wound about a cylindrical core, comprising:

a plurality of cylindrical body portions spaced apart along a length of the core, each respective body portion of the plurality of body portions including a first plurality of turns of tape, edges of each successive turn of tare of the first plurality of turns of tape in each respective body portion being offset by a fraction of a width of the tape from edges of an immediately prior turn of tape in a first direction;

wherein each respective body portion of the plurality of body portions further includes a second plurality of turns of tare overlying the first plurality of turns of tape, edges of each successive turn of tape of the second plurality of turns of tape in each respective body portion being offset from edges of an immediately prior turn of tape in a second direction that is opposite the first direction;

wherein the plurality of body portions include first and second end body portions, and at least one intermediate body portion disposed between the first and second end body portions, and wherein the second plurality of turns of tape of the first end body portion includes mare than four times as many turns as the second plurality of turns of tape in the at least one intermediate body portion.

50. A method of building a package of tape, comprising acts of:

wrapping a first plurality of turns of tape about a cylindrical core at a first position defined by a first pair of radial planes spaced apart along a length of the core so that edges of each approximately full turn of tare of the first plurality of turns of tape are laterally offset from edges of an immediately adjacent turn of tare by a fraction of a width of the tape and within the first pair of radial planes;

traversing to a second position defined by a second pair of radial planes spaced apart along the length of the core; and wrapping a second plurality of turns of tape about the cylindrical core at the second position so that edges of each approximately full turn of tape of the second plurality of turns of tape are laterally offset from edges of an immediately adjacent turn of tape by the fraction of the width of the tape and within the second pair of radial planes;

wherein the act of traversing includes an act of wrapping an approximately full turn of tape during the act of traversing;

wherein the fraction of the width of the tape is a first fraction of the width of the tape, and wherein the first pair of radial planes is spaced apart from the second pair of radial planes by a distance that is a second fraction of the width of the tape.

51. The method of claim 50, further comprising acts of:

traversing to a third position defined by a third pair of radial planes spaced apart along the length of the core; and wrapping a third plurality of turns of tape about the cylindrical core at the third position so that edges of each approximately full turn of tape of the third plurality of turns of tape are laterally offset from edges of an immediately adjacent turn of tape by the fraction of the width of the tape and within the third pair of radial planes.

52. The method of claim 51, further comprising acts of:

traversing to the second position; and wrapping a fourth plurality of turns of tape about the cylindrical core at the second position so that edges of each approximately full turn of tape of the fourth plurality of turns of tape are laterally offset from edges of an immediately adjacent turn of tape by the fraction of the width of the tape and within the second pair of radial planes.

53. The method of claim 51, wherein the act of wrapping the third plurality of turns of tape includes an act of wrapping approximately twice as many turns at the third position as a number of turns in the second plurality of turns.

54. A method of building a package of tape, comprising acts of:

wrapping a first plurality of turns of tape about a cylindrical core at a first position defined by a first pair of radial planes spaced apart along a length of the core so that edges of each approximately full turn of tare of the first plurality of turns of tape are laterally offset from edges of an immediately adjacent turn of tape by a fraction of a width of the tape and within the first pair of radial planes;

traversing to a second position defined by a second pair of radial planes spaced apart along the length of the core; and wrapping a second plurality of turns of tape about the cylindrical core at the second position so that edges of each approximately full turn of tape of the second plurality of turns of tape are laterally offset from edges of an immediately adjacent turn of tape by the fraction of the width of the tape and within the second pair of radial planes;

wherein the fraction of the width of the tape is a first fraction of the width of the tape, and wherein the first pair of radial planes is spaced apart from the second pair of radial planes by a distance that is a second fraction of the width of the tape.

55. The method of claim 54, wherein the act of traversing includes an act of wrapping an approximately full turn of tape during the act of traversing.

56. The method of claim 54, wherein the act of traversing includes an act of wrapping approximately one half of a turn of tape during the act of traversing.

57. The method of claim 54, wherein the act of traversing includes an act of wrapping approximately two full turns of tape during the act of traversing.

58. The method of claim 54, further comprising acts of:

traversing to a third position defined by a third pair of radial planes spaced apart along the length of the core;

wherein the second position is an intermediate body portion and the third position is an end body portion; and wrapping a third plurality of turns of tape about the cylindrical core at the third position so that edges of each approximately full turn of tape of the third plurality of turns of tape are laterally offset from edges of an immediately adjacent turn of tape by the fraction of the width of the tape and within the third pair of radial planes.

59. The method of claim 58, wherein the act of wrapping the third plurality of turns of tape includes an act of wrapping approximately twice as many turns at the third position as a number of turns in the second plurality of turns.

60. The method of claim 58, wherein the act of wrapping the third plurality of turns of tape includes an act of wrapping approximately three times as many turns at the third position as a number of turns in the second plurality of turns.

61. The method of claim 58, wherein the act of wrapping the third plurality of turns of tape includes an act of wrapping more than four times as many turns at the third position as a number of turns in the second plurality of turns.

62. The method of claim 54, further comprising an act of removing the package of tape from the core.

63. A method of building a package of tape, comprising acts of:

wrapping a first plurality of turns of tape about a cylindrical core at a first position defined by a first pair of radial planes spaced apart along a length of the core so that edges of a portion of each respective turn of tape of the first plurality of turns of tape are laterally offset from edges of an immediately adjacent portion of the respective turn of tape by a fraction of a width of the tape and within the first pair of radial planes;

traversing to a second position defined by a second pair of radial planes spaced apart along the length of the core; and wrapping a second plurality of turns of tape about the cylindrical core at the second position so that edges of a portion of each respective turn of tape of the second plurality of turns of tape are laterally offset from edges of an immediately adjacent portion of the respective turn of tape by the fraction of the width of the tape and within the second pair of radial planes;

wherein the act of traversing includes an act of wrapping an approximately full turn of tape during the act of traversing;

wherein the fraction of the width of the tape is a first fraction of the width of the tape, and wherein the first pair of radial planes is spaced apart from the second pair of radial planes by a distance that is a second fraction of the width of the tape.

64. The method of claim 63, further comprising acts of:

traversing to a third position defined by a third pair of radial planes spaced apart along the length of the core; and wrapping a third plurality of turns of tape about the cylindrical core at the third position so that edges of a portion of each respective turn of tape of the third plurality of turns of tape are laterally offset from edges of an immediately adjacent portion of the respective turn of tape by the fraction of the width of the tape and within the third pair of radial planes.

65. The method of claim 64, further comprising acts of:

traversing to the second position; and wrapping a fourth plurality of turns of tape about the cylindrical core at the second position so that edges of a portion of each respective turn of tape of the fourth plurality of turns of tape are laterally offset from edges an immediately adjacent portion of the respective turn of tape by the fraction of the width of the tape and within the second pair of radial planes.

66. The method of claim 64, wherein the act of wrapping the third plurality of turns of tape includes an act of wrapping approximately twice as many turns at the third position as a number of turns in the second plurality of turns.

67. A method of building a package of tape, comprising acts of:

wrapping a first plurality of turns of tape about a cylindrical core at a first position defined by a first pair of radial planes spaced apart along a length of the core so that edges of a portion of each respective turn of tape of the first plurality of turns of tape are laterally offset from edges of an immediately adjacent portion of the respective turn of tape by a fraction of a width of the tape and within the first pair of radial planes;

traversing to a second position defined by a second pair of radial planes spaced apart along the length of the core; and wrapping a second plurality of turns of tape about the cylindrical core at the second position so that edges of a portion of each respective turn of tape of the second plurality of turns of tape are laterally offset from edges of an immediately adjacent portion of the respective turn of tape by the fraction of the width of the tape and within the second pair of radial planes;

wherein the fraction of the width of the tape is a first fraction of the width of the tape, and wherein the first pair of radial planes is spaced apart from the second pair of radial planes by a distance that is a second fraction of the width of the tape.

68. The method of claim 67, wherein the act of traversing includes an act of wrapping approximately one half of a turn of tape during the act of traversing.

69. The method of claim 67, wherein the act of traversing includes an act of wrapping approximately two full turns of tape during the act of traversing.

70. The method of claim 67, wherein the act of traversing includes an act of wrapping an approximately full turn of tape during the act of traversing.

71. The method of claim 67, further comprising acts of:

traversing to a third position defined by a third pair of radial planes spaced apart along the length of the core;

wherein the second position is an intermediate body portion and the third position is an end body portion; and wrapping a third plurality of turns of tape about the cylindrical core at the third position so that edges of a portion of each respective turn of tape of the third plurality of turns of tape are laterally offset from edges of an immediately adjacent portion of the respective turn of tape by the fraction of the width of the tape and within the third pair of radial planes.

72. The method of claim 71, wherein the act of wrapping the third plurality of turns of tape includes an act of wrapping approximately twice as many turns at the third position as a number of turns in the second plurality of turns.

73. The method of claim 71, wherein the act of wrapping the third plurality of turns of tape includes an act of wrapping approximately three times as many turns at the third position as a number of turns in the second plurality of turns.

74. The method of claim 71, wherein the act of wrapping the third plurality of turns of tape includes an act of wrapping more than four times as many turns at the third position as a number of turns in the second plurality of turns.

75. The method of claim 67, further comprising an act of removing the package of tape from the core.

76. The method of claim 67, wherein the act of wrapping the first plurality of turns of tape includes an act of continuously varying a winding position of the tape along the length of the core.

77. The method of claim 67, wherein the act of wrapping the first plurality of turns of tape includes an act of varying a winding position of the tape along the length of the core.

78. A method of building a package of tape, comprising acts of:

wrapping a first plurality of turns of tape about a cylindrical core at a first position defined by a first pair of radial planes spaced apart along a length of the core so that edges of each successive turn of tape of the first plurality of turns of tape are laterally offset in a first direction by a fraction of a width of the tape from edges of an immediately prior turn of tape and within the first pair of radial planes;

traversing to a second position defined by a second pair of radial planes spaced apart along the length of the core, the second pair of radial planes being spaced apart from the first pair of radial planes; and wrapping a second plurality of turns of tape about the cylindrical core at the second position so that edges of each successive turn of tape of the second plurality of turns of tape are laterally offset in the first direction by the fraction of the width of the tape from edges of an immediately prior turn of tape and within the second pair of radial planes.

79. The method of claim 78, wherein the act of traversing includes an act of wrapping approximately one half of a turn of tape during the act of traversing.

80. The method of claim 78, wherein the act of traversing includes an act of wrapping approximately two fill turns of tape during the act of traversing.

81. The method of claim 78, wherein the act of traversing includes an act of wrapping an approximately full turn of tape during the act of traversing.

82. The method of claim 78, wherein the act of traversing includes an act of wrapping an approximately full turn of tape that contacts one of the edges of each of the first plurality of turns of tape during the act of traversing.

83. The method of claim 82, wherein the fraction of the width of the tape is a first fraction of the width of the tape, and wherein the first pair of radial planes overlaps the second pair of radial planes by a distance that is a second fraction of the width of the tape.

84. The method of claim 83, further comprising acts of:

traversing to a third position defined by a third pair of radial planes spaced apart along the length of the core, the third pair of radial planes being distinct from the first and second pairs of radial planes;

wherein the second position is an intermediate body portion and the third position is an end body portion; and wrapping a third plurality of turns of tape about the cylindrical core at the third position so that edges of each successive turn of tape of the third plurality of turns of tape are laterally offset in the first direction by the fraction of the width of the tape from edges of an immediately prior turn of tape and within the third pair of radial planes.

85. The method of claim 84, wherein the act of wrapping the third plurality of turns of tape includes an act of wrapping the third plurality of turns of tape about the cylindrical core at the third position so that one of the edges of each turn of tape of the third plurality of turns of tape contacts the approximately full turn of tape.

86. The method of claim 84, further comprising acts of:

traversing to the second position; and wrapping a fourth plurality of turns of tape about the cylindrical core at the second position so that edges of each successive turn of tape of the fourth plurality of turns of tape are laterally offset in a second direction that is opposite to the first direction by the fraction of the width of the tape from edges of an immediately prior turn of tape and within the second pair of radial planes.

87. The method of claim 84, wherein the act of wrapping the third plurality of turns of tape includes an act of wrapping approximately twice as many turns at the third position as a number of turns in the second plurality of turns.

88. The method of claim 84, wherein the act of wrapping the third plurality of turns of tape includes an act of wrapping approximately three times as many turns at the third position as a number of turns in the second plurality of turns.

89. The method of claim 84, wherein the act of wrapping the third plurality of turns of tape includes an act of wrapping more than four times as many turns at the third position as a number of turns in the second plurality of turns.

90. The method of claim 78, further comprising an act of removing the package of tape from the core.

91. The method of claim 78, further comprising acts of:

traversing to a third position defined by a third pair of radial planes spaced apart along the length of the core, the third pair of radial planes being distinct from the first and second pairs of radial planes; and wrapping a third plurality of turns of tape about the cylindrical core at the third position so that edges of each successive turn of tape of the third plurality of turns of tape are laterally offset in the first direction by the fraction of the width of the tape from edges of an immediately prior turn of tape and within the third pair of radial planes.

92. The method of claim 91, further comprising acts of:

traversing to the second position; and wrapping a fourth plurality of turns of tape about the cylindrical core at the second position so that edges of each successive turn of tape of the fourth plurality of turns of tape are laterally offset in a second direction that is opposite to the first direction by the fraction of the width of the tape from edges of an immediately prior turn of tape and within the second pair of radial planes.

93. The method of claim 78, wherein the act of wrapping the first plurality of turns of tape includes an act of continuously varying a winding position of the tape in the first direction along the length of the core.

94. The method of claim 78, wherein the act of wrapping the first plurality of turns of tape includes an act of varying a winding position of the tape in the first direction along the length of the core.

* * * * *